US010394169B2

(12) United States Patent
Hirose et al.

(10) Patent No.: US 10,394,169 B2
(45) Date of Patent: Aug. 27, 2019

(54) FIXING DEVICE AND IMAGE FORMING APPARATUS

(71) Applicant: Ricoh Company, Ltd., Tokyo (JP)

(72) Inventors: Fumihiro Hirose, Kanagawa (JP); Keisuke Kubota, Kanagawa (JP); Masami Okamoto, Kanagawa (JP); Jun Ogino, Kanagawa (JP); Kensuke Yamaji, Kanagawa (JP); Shuutaroh Yuasa, Kanagawa (JP); Yuuta Kanda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 6 days.

(21) Appl. No.: 15/675,834

(22) Filed: Aug. 14, 2017

(65) Prior Publication Data

US 2018/0081309 A1 Mar. 22, 2018

(30) Foreign Application Priority Data

Sep. 16, 2016 (JP) ..... 2016-181186

(51) Int. Cl.
*G03G 15/20* (2006.01)
*G03G 15/08* (2006.01)

(52) U.S. Cl.
CPC ..... *G03G 15/2025* (2013.01); *G03G 15/2039* (2013.01); *G03G 15/2053* (2013.01); *G03G 15/087* (2013.01); *G03G 2215/2032* (2013.01); *G03G 2215/2035* (2013.01)

(58) Field of Classification Search
CPC ..... G03G 15/2075; G03G 15/2053; G03G 15/2078; G03G 15/0836; G03G 15/2025
See application file for complete search history.

(56) References Cited

U.S. PATENT DOCUMENTS

| | | | | |
|---|---|---|---|---|
| 2002/0113050 | A1* | 8/2002 | Yura | G03G 15/2053 219/216 |
| 2009/0116884 | A1 | 5/2009 | Nonaka et al. | |
| 2012/0051766 | A1 | 3/2012 | Ueno et al. | |
| 2012/0288308 | A1 | 11/2012 | Kobashigawa | |
| 2013/0209147 | A1* | 8/2013 | Ogawa | G03G 15/2028 399/329 |
| 2014/0029991 | A1 | 1/2014 | Kubota | |
| 2014/0270865 | A1 | 9/2014 | Yamaji et al. | |

(Continued)

FOREIGN PATENT DOCUMENTS

| | | |
|---|---|---|
| JP | 63-092367 | 6/1988 |
| JP | 8-234605 | 9/1996 |

(Continued)

*Primary Examiner* — David M. Gray
*Assistant Examiner* — Michael A Harrison
(74) *Attorney, Agent, or Firm* — Xsensus LLP

(57) ABSTRACT

A fixing device includes a tubular rotator and a first heater disposed inside the tubular rotator and extended in a longitudinal direction of the first heater. The first heater heats the tubular rotator. A second heater is disposed inside the tubular rotator and extended in a longitudinal direction of the second heater. The second heater heats the tubular rotator. A heating adjuster is interposed between the first heater and the second heater. The heating adjuster adjusts heat conduction from the first heater to the second heater. A joint combines the heating adjuster with the second heater.

21 Claims, 5 Drawing Sheets

(56) References Cited

U.S. PATENT DOCUMENTS

| | | | | |
|---|---|---|---|---|
| 2016/0139549 | A1 | 5/2016 | Nozawa et al. | |
| 2016/0170350 | A1 | 6/2016 | Hirose et al. | |
| 2016/0306304 | A1 | 10/2016 | Hemmi et al. | |
| 2016/0306306 | A1 | 10/2016 | Nozawa et al. | |
| 2016/0378027 | A1* | 12/2016 | Sawada ..... | G03G 15/2053<br>399/329 |

FOREIGN PATENT DOCUMENTS

| | | |
|---|---|---|
| JP | 2002-031974 | 1/2002 |
| JP | 2005-202202 | 7/2005 |
| JP | 2009-115969 | 5/2009 |
| JP | 2012-234105 | 11/2012 |
| JP | 2016-114942 | 6/2016 |

* cited by examiner

FIXING DEVICE AND IMAGE FORMING APPARATUS

CROSS-REFERENCE TO RELATED APPLICATION

This patent application is based on and claims priority pursuant to 35 U.S.C. § 119 to Japanese Patent Application No. 2016-181186, filed on Sep. 16, 2016, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one embodiment, the fixing device includes a tubular rotator and a first heater disposed inside the tubular rotator and extended in a longitudinal direction of the first heater. The first heater heats the tubular rotator. A second heater is disposed inside the tubular rotator and extended in a longitudinal direction of the second heater. The second heater heats the tubular rotator. A heating adjuster is interposed between the first heater and the second heater. The heating adjuster adjusts heat conduction from the first heater to the second heater. A joint combines the heating adjuster with the second heater.

This specification further describes an improved image forming apparatus. In one embodiment, the image forming apparatus includes an image forming device to form a toner image on a recording medium and a fixing device to fix the toner image on the recording medium. The fixing device includes a tubular rotator and a first heater disposed inside the tubular rotator and extended in a longitudinal direction of the first heater. The first heater heats the tubular rotator. A second heater is disposed inside the tubular rotator and extended in a longitudinal direction of the second heater. The second heater heats the tubular rotator. A heating adjuster is interposed between the first heater and the second heater. The heating adjuster adjusts heat conduction from the first heater to the second heater. A joint combines the heating adjuster with the second heater.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
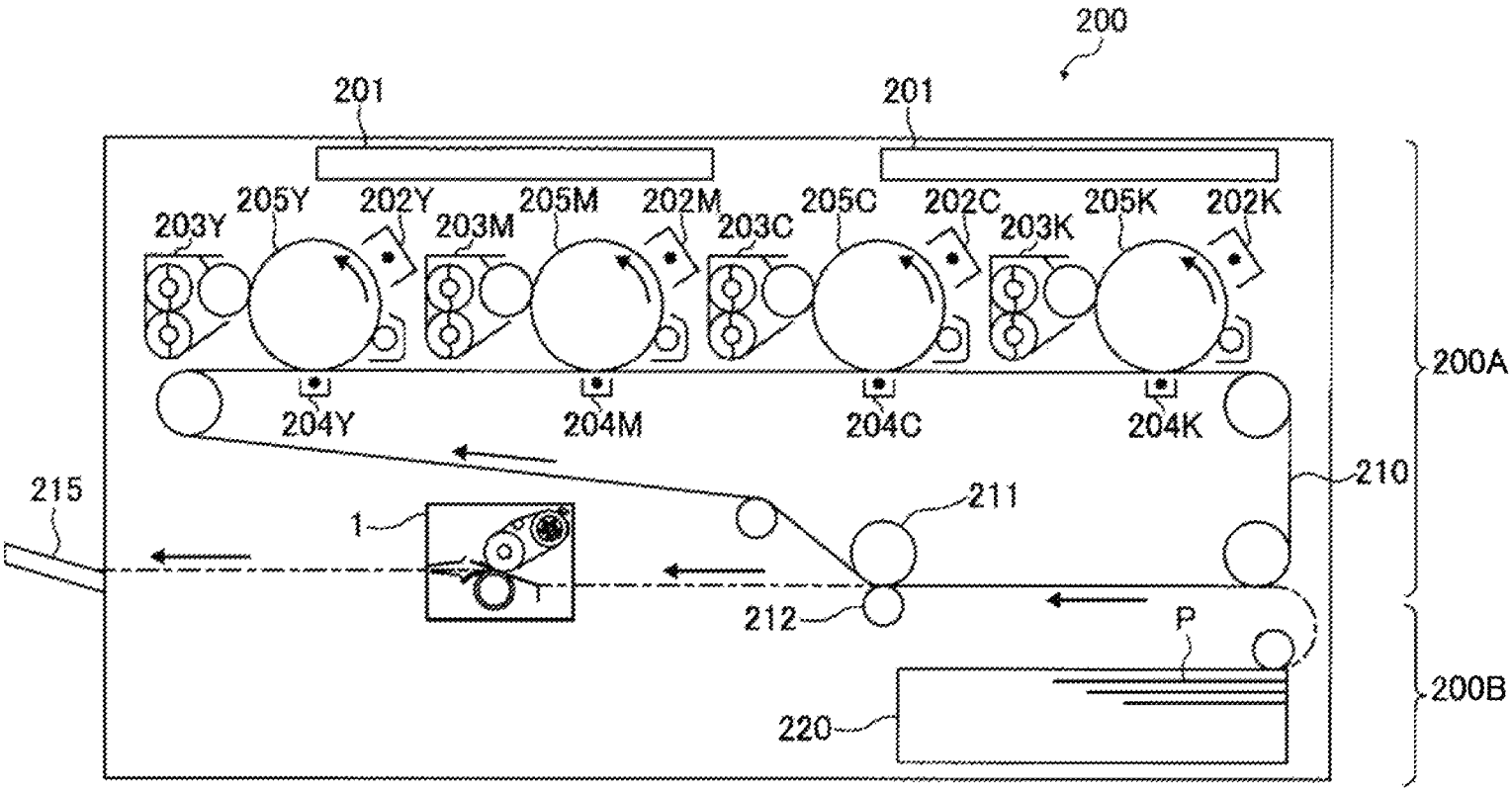
FIG. 1 is a schematic vertical cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity.

However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 200 according to an embodiment is explained.

FIG. 1 is a schematic vertical cross-sectional view of the image forming apparatus 200. The image forming apparatus 200 may be a copier, a facsimile machine, a printer, a multifunction peripheral or a multifunction printer (MFP) having at least one of copying, printing, scanning, facsimile, and plotter functions, or the like. According to this embodiment, the image forming apparatus 200 is a color printer that forms a color toner image on a recording medium by electrophotography. Alternatively, the image forming apparatus 200 may be a monochrome printer that forms a monochrome toner image on a recording medium.

Referring to FIG. 1, a description is provided of a construction of the image forming apparatus 200.

FIG. 1 illustrates the construction of the image forming apparatus 200 as a tandem color copier that forms a color toner image on a recording medium. The image forming apparatus 200 is a high speed machine that forms the color toner image on the recording medium at high speed. The image forming apparatus 200 includes an image forming device 200A, a sheet feeder 200B, and a fixing device 1.

A description is provided of a construction of the image forming device 200A.

The image forming device 200A includes a transfer belt 210 having a transfer face extending horizontally in FIG. 1. An upper face of the transfer belt 210 is disposed opposite components that form toner images in complementary colors created based on separation colors. For example, photoconductors 205Y, 205M, 205C, and 205K, serving as image bearers that bear yellow, magenta, cyan, and black toner images in the complementary colors, respectively, are aligned along the transfer face of the transfer belt 210.

Each of the photoconductors 205Y, 205M, 205C, and 205K is a drum rotatable counterclockwise in FIG. 1 in an identical direction. The photoconductors 205Y, 205M, 205C, and 205K are surrounded by two optical writing devices 201, chargers 202Y, 202M, 202C, and 202K, developing devices 203Y, 203M, 203C, and 203K, and primary transfer devices 204Y, 204M, 204C, and 204K, respectively, which perform image formation processes as the photoconductors 205Y, 205M, 205C, and 205K rotate. The developing devices 203Y, 203M, 203C, and 203K contain yellow, magenta, cyan, and black toners, respectively.

The transfer belt 210 looped over a driving roller and a plurality of driven rollers is disposed opposite the photoconductors 205Y, 205M, 205C, and 205K and rotatable clockwise in FIG. 1 as the photoconductors 205Y, 205M, 205C, and 205K rotate counterclockwise in FIG. 1. An opposed roller 211, that is, one of the plurality of driven rollers, is disposed opposite a transfer roller 212 via the transfer belt 210. A conveyance path extends horizontally from the transfer roller 212 to the fixing device 1 to convey a sheet P sent from the sheet feeder 200B.

A description is provided of a construction of the sheet feeder 200B.

The sheet feeder 200B includes a paper tray 220 that loads a plurality of sheets P serving as recording media and a feed device that separates an uppermost sheet P from other sheets P loaded on the paper tray 220 one by one and conveys the sheet P to the transfer roller 212.

A description is provided of an image formation to form a toner image on a sheet P that is performed by the image forming apparatus 200 having the construction described above.

The charger 202Y uniformly changes an outer circumferential surface of the photoconductor 205Y. The optical writing device 201 forms an electrostatic latent image on the photoconductor 205Y according to image data sent from an image reader. The developing device 203Y containing yellow toner visualizes the electrostatic latent image into a yellow toner image. The primary transfer device 204Y applied with a predetermined bias primarily transfers the yellow toner image onto the transfer belt 210. Similarly, magenta, cyan, and black toner images are formed on the photoconductors 205M, 205C, and 205K, respectively, and primarily transferred onto the transfer belt 210 successively by an electrostatic force such that the yellow, magenta, cyan, and black toner images are superimposed on a same position on the transfer belt 210, thus forming a color toner image on the transfer belt 210.

The opposed roller 211 and the transfer roller 212 secondarily transfer the color toner image formed on the transfer belt 210 onto the sheet P conveyed from the paper tray 220. The sheet P bearing the color toner image is conveyed further to the fixing device 1 where the color toner image is fixed on the sheet P as the sheet P passes through the fixing device 1. The sheet P ejected from the fixing device 1 is conveyed onto an output tray 215 through an output path.

Referring to FIGS. 2 to 7, a description is provided of a construction of the fixing device 1 according to a first embodiment of the present disclosure.

Figure 2:
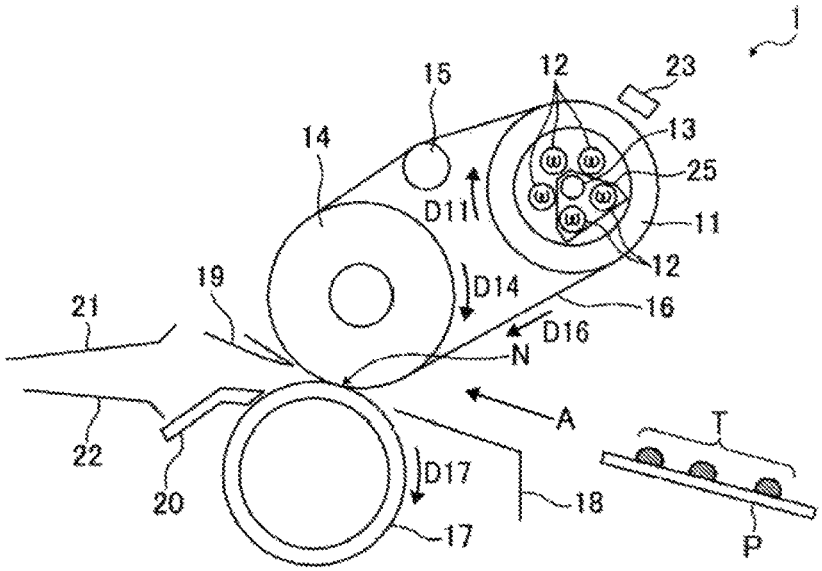
FIG. 2 is a schematic vertical cross-sectional view of a fixing device incorporated in the image forming apparatus depicted in FIG. 1.

FIG. 2 is a schematic vertical cross-sectional view of the fixing device 1. As illustrated in FIG. 2, the fixing device 1 (e.g., a fuser or a fusing unit) includes a heating roller 11, a plurality of infrared heaters 12, a heating adjuster 13, a fixing roller 14, a tension roller 15, a fixing belt 16, a pressure roller 17, an entry guide 18, a separation plate 19, a separation claw 20, an upper exit guide 21, a lower exit guide 22, and a temperature sensor 23. The pressure roller 17 is pressed against the fixing roller 14 via the fixing belt 16 to form a fixing nip N between the pressure roller 17 and the fixing belt 16. As a sheet P bearing a toner image T is conveyed through the fixing nip N in a sheet conveyance direction A, the fixing belt 16 and the pressure roller 17 fix the toner image T on the sheet P under heat and pressure.

A description is provided of a configuration of the heating roller 11.

The heating roller 11 serves as a heating rotator that heats the fixing belt 16. The heating roller 11 is a tubular hollow roller made of aluminum or iron, for example. The heating roller 11 is disposed opposite the fixing roller 14 with a clearance therebetween such that a shaft of the heating roller 11 is parallel to a shaft of the fixing roller 14. Inside the heating roller 11 are the plurality of infrared heaters 12 and the heating adjuster 13. For example, the heating roller 11 serves as a heating rotator that is a tubular rotator accommodating the infrared heaters 12 and the heating adjuster 13.

Figure 3:
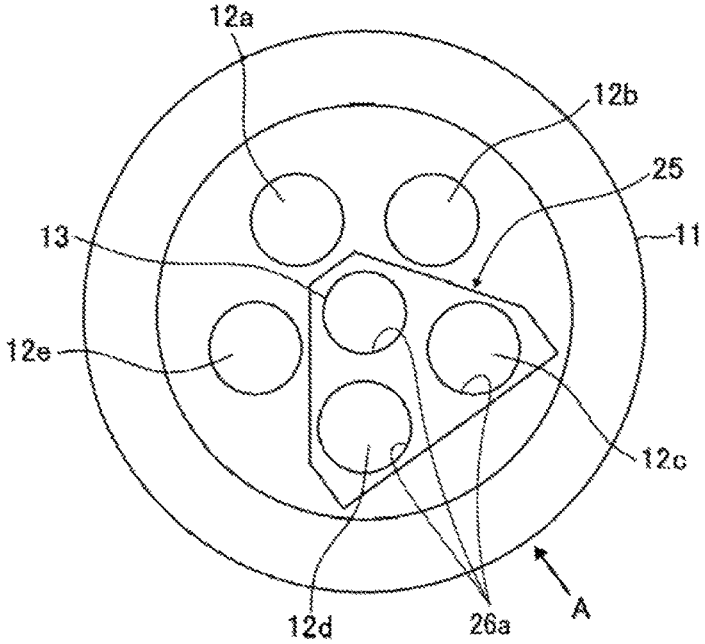
FIG. 3 is an enlarged vertical cross-sectional view of a heating roller incorporated in the fixing device depicted in FIG. 2.

FIG. 3 is an enlarged vertical cross-sectional view of the heating roller 11. As illustrated in FIG. 3, inside the heating roller 11 are the plurality of infrared heaters 12, that is, five infrared heaters 12*a*, 12*b*, 12*c*, 12*d*, and 12*e*. Further, the heating adjuster 13 is disposed inside the heating roller 11.

A description is provided of a configuration of the infrared heaters 12*a*, 12*b*, 12*c*, 12*d*, and 12*e*.

The infrared heaters 12*a*, 12*b*, 12*c*. 12*d*, and 12*e* may be hereinafter referred to as the infrared heaters 12. The infrared heaters 12*a*, 12*b*, 12*c*, 12*d*, and 12*e* are general heaters. For example, each of the infrared heaters 12*a*, 12*b*, 12*c*, 12*d*, and 12*e* is tubular and extended in a longitudinal direction of the heating roller 11. A wiring or the like is coupled to both lateral ends or one lateral end of each of the infrared heaters 12 to supply power to each of the infrared heaters 12. As one example of this embodiment, each of the infrared heaters 12 has a rated power of 1000 W and a diameter of 8 mm. While the sheet P is conveyed through the fixing device 1, the five infrared heaters 12 are powered on simultaneously at maximum to attain a total rated power of 5000 W obtained by multiplying 1000 W by 5.

The five infrared heaters 12*a*, 12*b*, 12*c*, 12*d*, and 12*e* are arranged along an inner circumferential surface of the heating roller 11 having a predetermined circumference such that the infrared heaters 12*a*, 12*b*, 12*c*, 12*d*, and 12*e* are evenly spaced each other with an even clearance between the adjacent infrared heaters 12 in cross-section. As one example of this embodiment, the clearance between the adjacent infrared heaters 12 is 3.75 mm. The fixing device 1 according to this embodiment includes the five infrared heaters 12. Alternatively, the fixing device 1 may include two or more infrared heaters 12 as long as the infrared heaters 12 are situated inside the heating roller 11.

According to this embodiment, the infrared heaters 12*a*, 12*b*, 12*c*. 12*d*, and 12*e* are used as the plurality of heaters. Alternatively, other heaters such as halogen heaters may be used as the plurality of heaters. Additionally, the heater may not be tubular. For example, the heater may be rectangular, platy, or the like in cross-section. That is, the heater may have other shapes as long as the heater extends in the longitudinal direction of the heating roller 11.

A description is provided of a configuration of the heating adjuster 13.

The heating adjuster 13 made of glass is tubular and extended in the longitudinal direction of the heating roller 11. The heating adjuster 13 is a hollow tube. The hollow tube of the heating adjuster 13 is filled with gas such as air and nitrogen. As one example of this embodiment, the heating adjuster 13 has a diameter of 6 mm. The heating adjuster 13 is situated at a center inside the heating roller 11. An even and minimum distance is provided between the heating adjuster 13 and each of the infrared heaters 12*a*, 12*b*, 12*c*, 12*d*, and 12*e*. Since a projection may be produced on the heating adjuster 13 due to molding, the heating adjuster 13 may be shifted slightly from a position that defines the even and minimum distance between the heating adjuster 13 and each of the infrared heaters 12*a*, 12*b*, 12*c*, 12*d*, and 12*e*. However, the heating adjuster 13 is situated at a position as close as possible to the position that defines the even and minimum distance provided between the heating adjuster 13 and each of the infrared heaters 12*a*. 12*b*, 12*c*, 12*d*, and 12*e*.

The heating adjuster 13 is a non-heat generator that does not generate heat. The heating adjuster 13 absorbs heat generated by the infrared heaters 12 which surround the heating adjuster 13. Heat absorbed by the heating adjuster 13 is cooled at or exhausted from both lateral ends of the heating adjuster 13 in a longitudinal direction thereof by thermal conduction. Accordingly, for example, although the infrared heater 12*a* is heated directly by the adjacent infrared heaters 12*b* and 12*e*, the infrared heater 12*a* is heated less by the infrared heaters 12*c* and 12*d* that are disposed opposite the infrared heater 12*a* via the heating adjuster 13. Consequently, the infrared heater 12*a* is less susceptible to overheating to a temperature higher than a specified temperature (e.g., a heat resistant temperature). The heating adjuster 13 interposed between the plurality of infrared heaters 12 absorbs heat from the infrared heaters 12, thus performing adjustment to prevent one infrared heater 12 from overheating another infrared heater 12.

The plurality of infrared heaters 12 and the heating adjuster 13 may not be aligned on a straight line. As illustrated in FIG. 3, at least a part of the heating adjuster 13 may block heat from one infrared heater 12.

Although the temperature inside the heating roller 11 varies depending on output from the infrared heaters 12 and the number of the infrared heaters 12, the temperature inside the heating roller 11 may increase to about 900 degrees centigrade, for example. To address this circumstance, the heating adjuster 13 may be made of quartz glass that does not melt at 900 degrees centigrade and barely expands thermally. Alternatively, the heating adjuster 13 may be made of other glass material or other heat resistant material that does not melt at 900 degrees centigrade and barely expands thermally, which is selected according to the temperature inside the heating roller 11. Other glass material includes Neoceram® and Pyrex®, for example. Instead of glass, the heating adjuster 13 may be made of other heat resistant material such as ceramics as long as the heat resistant material has a small thermal conductivity and suppresses sharp temperature increase of the heating adjuster 13.

According to this embodiment, each of the five infrared heaters 12*a*, 12*b*, 12*c*, 12*d*, and 12*e* is a heater including a glass tube having a diameter of 8 mm. A clearance in a range of from about 3 mm to about 4 mm is provided between a surface of one glass tube and a surface of the adjacent glass tube of the five infrared heaters 12*a*, 12*b*, 12*c*, 12*d*, and 12*e* disposed opposite each other densely. As each of the glass tubes receives radiation heat, the glass tube of the infrared heater 12, which is made of quartz glass, may be heated to a temperature higher than a heat resistant temperature of 900 degrees centigrade (e.g., an upper limit temperature for usage of 850 degrees centigrade). Accordingly, the glass tube may suffer from blackening. If a halogen heater is used, the halogen heater may suffer from usage outside a halogen cycle. In the example described above, the infrared heaters 12 suffer from blackening at a rated power of about 5000 W or more. Hence, the heating adjuster 13 is needed. If the heating adjuster 13 according to this embodiment has a diameter of 6 mm, a clearance in a range of from about 4 mm to about 5 mm (e.g., in a range not smaller than 4 mm and not greater than 5 mm) is provided between the surface of one glass tube and the surface of the adjacent glass tube of the five infrared heaters 12.

As illustrated in FIG. 2, the diameter of the heating adjuster 13 is smaller than the diameter of each of the infrared heaters 12. Alternatively, the diameter of the heating adjuster 13 may be equal to the diameter of each of the infrared heaters 12. Yet alternatively, the diameter of the heating adjuster 13 may be greater than the diameter of each of the infrared heaters 12. The shape of the heating adjuster 13 in cross-section may be circular or polygonal. For example, since the fixing device 1 according to this embodiment includes the five infrared heaters 12, the heating adjuster 13 may be a pentagon in which five sides or five vertexes are disposed opposite the five infrared heaters 12, respectively.

Figure 4:
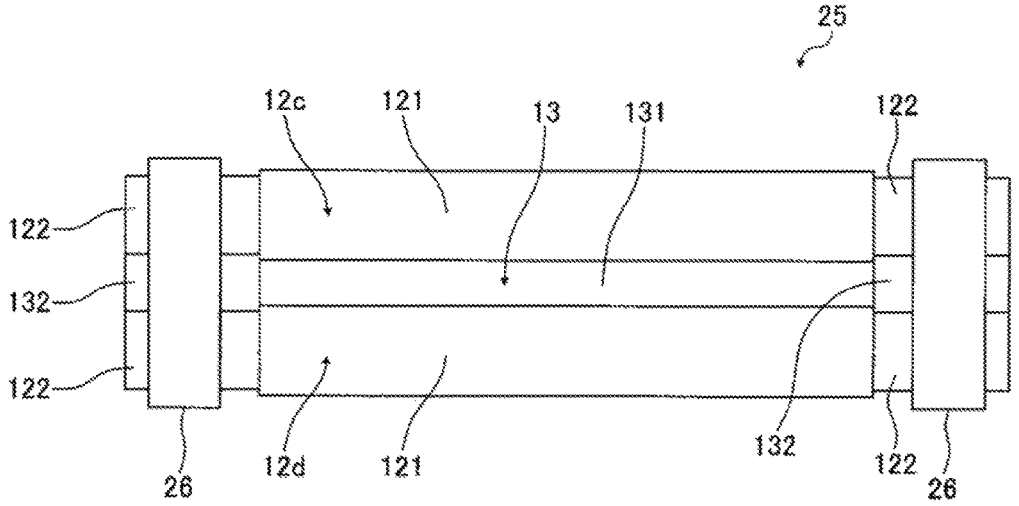
FIG. 4 is a side view of a combining unit according to a first embodiment disposed inside the heating roller depicted in FIG. 3, which is seen in a sheet conveyance direction.

According to this embodiment, as illustrated in FIGS. 3 and 4, the fixing device 1 further includes a combining unit 25 constructed of the infrared heaters 12*c* and 12*d*, the heating adjuster 13, and a joint 26 that combines the infrared heaters 12*c* and 12*d* and the heating adjuster 13.

FIG. 4 is a side view of the combining unit 25 seen in the sheet conveyance direction A in FIG. 3. As illustrated in FIG. 4, each of the infrared heaters 12*c* and 12*d* includes a heating portion 121 and a sealing portion 122. The heating portion 121 generates heat. The sealing portion 122 adjoins each lateral end of the heating portion 121 in a longitudinal direction of the infrared heaters 12*c* and 12*d*. The heating adjuster 13 includes an adjusting portion 131 and a sealing portion 132. The adjusting portion 131 is disposed opposite the heating portion 121 and adjusts heat conduction. The sealing portion 132 adjoins each lateral end of the adjusting portion 131 in the longitudinal direction of the heating adjuster 13.

The joint 26 includes a through hole 26*a* depicted in FIG. 3 into which each of the sealing portions 122 and 132 is inserted so that the sealing portions 122 and 132 are secured to the joint 26 with the above-described distance that is provided between the heating adjuster 13 and each of the infrared heaters 12*c* and 12*d*. The joint 26 combines the infrared heaters 12*c* and 12*d* and the heating adjuster 13 at each lateral end of the infrared heaters 12*c* and 12*d* and the heating adjuster 13 in the longitudinal direction thereof. Although the joint 26 is not heated by the infrared heaters 12*c* and 12*d* directly, since the joint 26 is disposed in proximity to the infrared heaters 12*c* and 12*d* and therefore is heated to a high temperature, the joint 26 is made of a material that is resistant to the high temperature.

Figure 5:
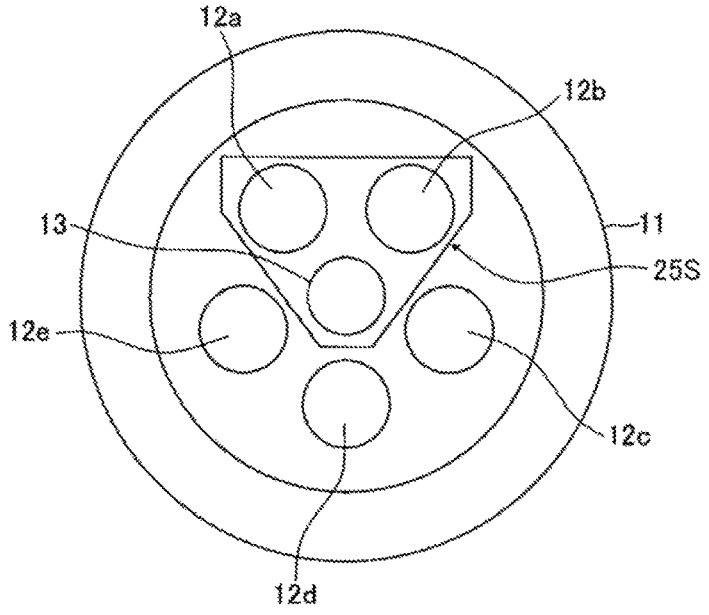
FIG. 5 is a schematic vertical cross-sectional view of a combining unit as a first variation of the combining unit depicted in FIG. 4.

As illustrated in FIG. 5, the joint 26 may combine other infrared heaters 12 with the heating adjuster 13. For example, the joint 26 may combine the infrared heaters 12*a* and 12*b* with the heating adjuster 13. FIG. 5 is a schematic vertical cross-sectional view of a combining unit 25S in which the infrared heaters 12*a* and 12*b* and the heating adjuster 13 are combined. That is, one or more infrared heaters 12 and the heating adjuster 13 may be combined. The shape of the joint 26 is not limited to the shape illustrated in FIG. 4. That is, the joint 26 may have any shape other than the shape illustrated in FIG. 4 as long as the joint 26 retains the positional relation of the joint 26 with respect to the infrared heaters 12 and the heating adjuster 13. The joint 26 may combine the infrared heaters 12 and the heating adjuster 13 at one lateral end instead of both lateral ends thereof in the longitudinal direction.

A description is provided of a construction of the fixing roller 14.

The fixing roller 14 depicted in FIG. 2 is a tubular roller constructed of a core bar made of aluminum, iron, or the like and an elastic layer coating the core bar and being made of silicone rubber or the like, for example. Alternatively, the elastic layer may be made of silicone rubber foam to reduce heat absorbed from the fixing belt 16 into the fixing roller 14 and thereby shorten a warm-up time to warm up the fixing belt 16 to a target temperature. The fixing roller 14 is a tubular rotator that is driven and rotated by a driver including a motor and a gear.

A description is provided of a configuration of the tension roller 15.

The tension roller 15 is a tubular roller that places an appropriate tension to the fixing belt 16. For example, the appropriate tension is determined to attain a friction that prevents an inner circumferential surface of the fixing belt 16 from sliding over an outer circumferential surface of the heating roller 11 and the fixing roller 14.

A description is provided of a construction of the fixing belt 16.

The fixing belt 16 is an endless belt looped over the heating roller 11 and the fixing roller 14. The fixing belt 16 is a triple layered endless belt in cross-section constructed of a base layer being made of nickel, stainless steel, polyimide, or the like, an elastic layer coating the base layer and being made of silicone rubber or the like, and a release layer coating the elastic layer and being made of tetrafluoroethylene-perfluoroalkoxy ethylene copolymer (PFA). The fixing belt 16 is looped over and stretched taut across the heating roller 11 and the fixing roller 14 with a predetermined tension. As described above, the tension roller 15 places the appropriate tension to the fixing belt 16 to attain the friction that prevents the inner circumferential surface of the fixing belt 16 from sliding over the outer circumferential surface of the heating roller 11 and the fixing roller 14. Hence, as illustrated in FIG. 2, as the driver drives and rotates the fixing roller 14 in a rotation direction D14, the fixing roller 14 rotates the fixing belt 16 in a rotation direction D16. Thus, the heating roller 11 as a driven roller is driven and rotated in a rotation direction D11 by the fixing belt 16.

A description is provided of a construction of the pressure roller 17.

The pressure roller 17 is pressed against the fixing roller 14 via the fixing belt 16. The pressure roller 17 is a tubular roller constructed of a core bar made of metal such as aluminum and iron and an elastic layer coating the core bar and being made of silicone rubber or the like, for example. The pressure roller 17 is rotatable in a rotation direction D17. An outer circumferential surface of the pressure roller 17 is pressed against the fixing roller 14 via the fixing belt 16. The pressure roller 17 is pressed against the fixing roller 14 via the fixing belt 16 to form the fixing nip N between the pressure roller 17 and the fixing belt 16. Thus, the pressure roller 17 serves as a pressure rotator and the fixing roller 14 serves as a fixing rotator.

A description is provided of a configuration of the entry guide 18.

The entry guide 18 is a plate that guides the sheet P bearing the unfixed toner image T to the fixing nip N.

A description is provided of a configuration of the separation plate 19 and the separation claw 20.

The separation plate 19 prevents the sheet P from being wound around the fixing belt 16 and separates the sheet P from the fixing belt 16. The separation claw 20 prevents the sheet P from being wound around the pressure roller 17 and separates the sheet P from the pressure roller 17.

A description is provided of a configuration of the upper exit guide 21 and the lower exit guide 22.

The upper exit guide 21 is a plate that guides the sheet P bearing the toner image T fixed thereon while the sheet P is conveyed through the fixing nip N to the output tray 215 or the like depicted in FIG. 1. The lower exit guide 22 is a plate that guides the sheet P bearing the toner image T fixed thereon while the sheet P is conveyed through the fixing nip N to the output tray 215 or the like depicted in FIG. 1. The upper exit guide 21 and the lower exit guide 22 guide the sheet P to the output tray 215 or the like while the upper exit guide 21 and the lower exit guide 22 sandwich the sheet P.

A description is provided of a configuration of the temperature sensor 23.

The temperature sensor 23 is disposed in proximity to an outer circumferential surface of the fixing belt 16. The temperature sensor 23 detects the temperature of the outer circumferential surface of the fixing belt 16. The infrared heaters 12 are controlled based on the detected temperature of the fixing belt 16.

With the fixing device 1 having the construction described above, a controller (e.g., a processor), that is, a central processing unit (CPU) provided with a random-access memory (RAM) and a read-only memory (ROM), for example, operatively connected to the temperature sensor 23 and the infrared heaters 12 controls the infrared heaters 12 based on the temperature of the outer circumferential surface of the fixing belt 16 detected by the temperature sensor 23 to adjust the temperature of the outer circumferential surface of the fixing belt 16 to a predetermined temperature. For example, the controller controls the infrared heaters 12 by turning on and off the infrared heaters 12 simultaneously.

The infrared heaters 12 heat the heating roller 11 which in turn heats the fixing belt 16. The driver drives and rotates the fixing roller 14 in the rotation direction D14 which in turn rotates the fixing belt 16 heated by the infrared heaters 12 in the rotation direction D16.

The sheet P bearing the unfixed toner image T, after entering the fixing device 1, is guided by the entry guide 18 and conveyed through the fixing nip N where the fixing belt 16 and the pressure roller 17 melt and fix the unfixed toner image T on the sheet P. The upper exit guide 21 and the lower exit guide 22 guide the sheet P to the output tray 215 or the like.

A description is provided of a construction of a first comparative fixing device employing a heating roller fixing system.

The first comparative fixing device includes a fixing roller accommodating a heater such as an infrared heater and a pressure roller pressed against the fixing roller to form a fixing nip therebetween. As a recording medium bearing an unfixed toner image is conveyed through the fixing nip while the recording medium is sandwiched between the fixing roller and the pressure roller, the fixing roller and the pressure roller fix the toner image on the recording medium under heat and pressure.

A description is provided of a construction of a second comparative fixing device employing a belt fixing system.

The second comparative fixing device includes an endless fixing belt, a heating roller accommodating an infrared heater or the like, a fixing roller, and a pressure roller. The fixing belt is stretched taut across the heating roller and the fixing roller. The pressure roller is pressed against the fixing belt to form a fixing nip therebetween. As a recording medium bearing an unfixed toner image is conveyed through the fixing nip while the recording medium is sandwiched between the fixing belt and the pressure roller, the fixing belt and the pressure roller fix the toner image on the recording medium under heat and pressure.

With the first comparative fixing device and the second comparative fixing device, if the recording medium is conveyed at high speed or the thickness of the recording medium increases, the recording medium may draw more heat from the fixing roller or the fixing belt. To address this circumstance, a plurality of heaters is disposed inside the fixing roller or the heating roller to retain the temperature of the fixing roller or the fixing belt.

However, the plurality of heaters may heat each other to a temperature higher than a specified temperature of the heaters, resulting in substantial degradation of the heaters. To address this circumstance, a heating adjuster is disposed between the heaters, thus suppressing thermal degradation of the heaters.

The heating adjuster is disposed close to the heaters. Accordingly, when the heating adjuster and the heaters are assembled into the first comparative fixing device or the second comparative fixing device, the heating adjuster may come into contact with the heaters, causing the heating adjuster and the heaters to damage each other.

To address this circumstance, according to this embodiment, as illustrated in FIGS. 3 and 4, the fixing device 1 includes the combining unit 25 in which the heating adjuster 13 is combined with the infrared heaters 12*c* and 12*d*. The combining unit 25 is assembled separately from assembly of the fixing device 1, preventing the heating adjuster 13 from coming into contact with the infrared heaters 12*c* and 12*d*. When the fixing device 1 is assembled, the combining unit 25 that has been assembled is installed into the fixing device 1, preventing the heating adjuster 13 from coming into contact with the infrared heaters 12*c* and 12*d* and facilitating installation of the combining unit 25 into the fixing device 1 during assembly of the fixing device 1.

The joint 26 combines the heating adjuster 13 with the infrared heaters 12*c* and 12*d* at each lateral end of the heating adjuster 13 and the infrared heaters 12*c* and 12*d* in the longitudinal direction thereof without adversely affecting heating by the infrared heaters 12*c* and 12*d* and heating adjustment by the heating adjuster 13.

The heating adjuster 13 made of glass is situated at the center inside the heating roller 11, which is surrounded by the infrared heaters 12 arranged along the inner circumferential surface of the heating roller 11. Accordingly, the heating adjuster 13 absorbs heat generated by the infrared heaters 12 and reduces heat conducted directly from one infrared heater 12 to another infrared heater 12 disposed opposite the one infrared heater 12, thus decreasing overheating of the infrared heater 12 to a temperature above the specified temperature. Consequently, the heating adjuster 13 suppresses thermal degradation of the infrared heaters 12. Hence, the heating adjuster 13 extends the life of the infrared heaters 12.

The even distance is provided between the heating adjuster 13 and each of the infrared heaters 12*a*, 12*b*, 12*c*, 12*d*, and 12*e*. Accordingly, the heating adjuster 13 evens the temperature inside the heating roller 11 heated by each of the infrared heaters 12*a*, 12*b*, 12*c*, 12*d*, and 12*e*.

Since the heating adjuster 13 is made of glass that has a decreased thermal conductivity, the heating adjuster 13 is immune from sharp temperature increase.

Since the heating adjuster 13 is made of quartz glass that has a substantially decreased coefficient of thermal expansion, the heating adjuster 13 is immune from thermal expansion. Accordingly, even if the heating roller 11 has a small diameter, the heating adjuster 13 is situated inside a limited space defined by the heating roller 11.

The fixing device 1 includes the pressure roller 17 serving as a pressure rotator that is pressed against the fixing roller 14 via the fixing belt 16. The pressure roller 17 is pressed against the fixing roller 14 via the fixing belt 16 to form the fixing nip N between the pressure roller 17 and the fixing belt 16. Thus, the fixing device 1 attains the belt fixing system in which the fixing belt 16 is warmed up for a shortened warm-up time before the fixing belt 16 melts and fixes the unfixed toner image T on the sheet P.

The combining unit 25 includes the joint 26 that combines the heating adjuster 13 with the infrared heaters 12. Alternatively, if the tube of each of the infrared heaters 12 and the heating adjuster 13 are made of an identical material such as glass, the infrared heaters 12 may be molded with the heating adjuster 13. In this case, instead of the shape of the joint 26 illustrated in FIGS. 3 and 4, the heating adjuster 13 may be coupled to and combined with each of the infrared heaters 12 through a column or the like with a clearance between the heating adjuster 13 and each of the infrared heaters 12.

Figure 6:
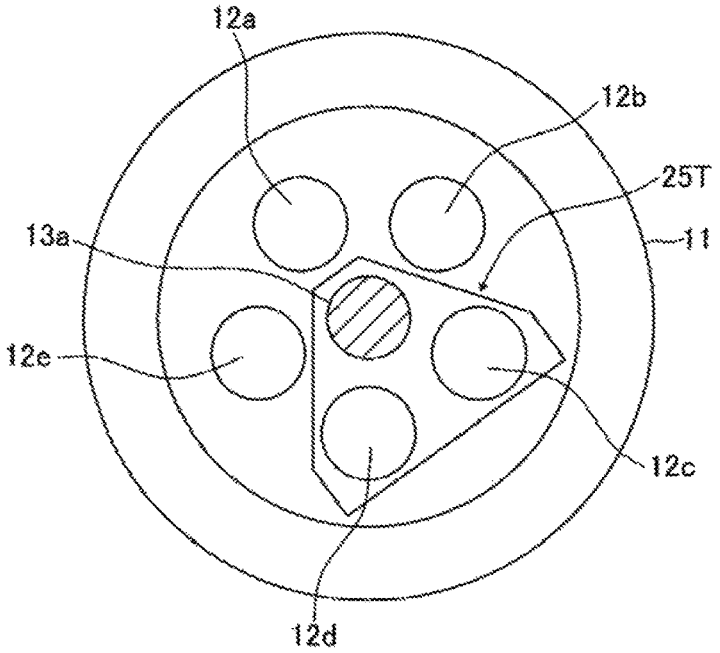
FIG. 6 is a schematic vertical cross-sectional view of a combining unit as a second variation of the combining unit depicted in FIG. 4.

The heating adjuster 13 is a hollow tube. Alternatively, the heating adjuster 13 may be a solid bar FIG. 6 is a schematic vertical cross-sectional view of a combining unit 25T incorporating a heating adjuster 13*a*. As illustrated in FIG. 6, the heating adjuster 13*a* is a solid bar. The heating adjuster 13*a* attains advantages of heating adjustment that are equivalent to the advantages of heating adjustment attained by the heating adjuster 13 depicted in FIGS. 3 to 5.

Figure 7:
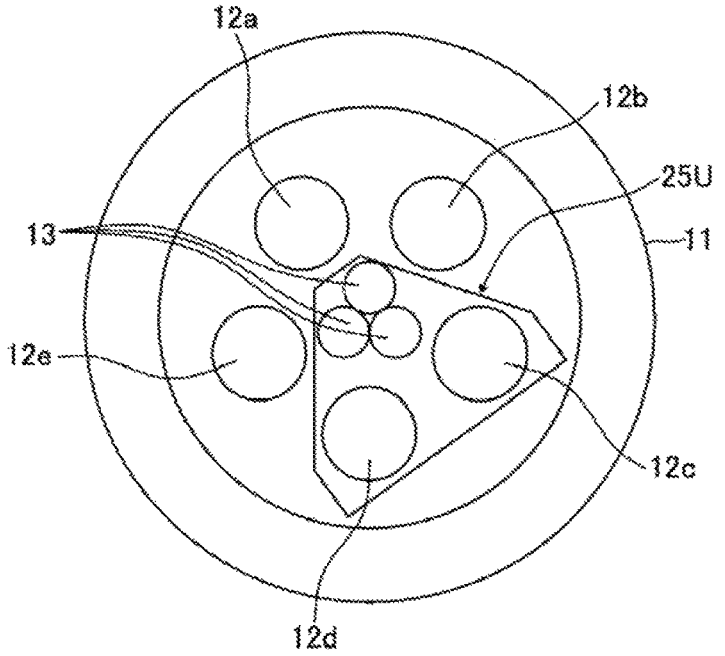
FIG. 7 is a schematic vertical cross-sectional view of a combining unit as a third variation of the combining unit depicted in FIG. 4.

The combining unit 25 depicted in FIG. 3 includes the single heating adjuster 13. Alternatively, the combining unit 25 may include a plurality of heating adjusters 13. FIG. 7 is a schematic vertical cross-sectional view of a combining unit 25U including the plurality of heating adjusters 13. As illustrated in FIG. 7, the combining unit 25U incorporates the plurality of heating adjusters 13 situated at the center of the heating roller 11. The number of the heating adjusters 13 is not limited to three as illustrated in FIG. 7. FIG. 7 illustrates the three heating adjusters 13 being disposed densely and being in contact with each other. Alternatively, the three heating adjusters 13 may be disposed adjacent to each other such that an even clearance is provided between the center of the heating roller 11 in cross-section and each of the heating adjusters 13 and an even clearance is provided between the adjacent heating adjusters 13. In those cases, the size, the position, and the like of the through holes 26*a* of the joint 26 are modified according to the heating adjusters 13.

Figure 8:
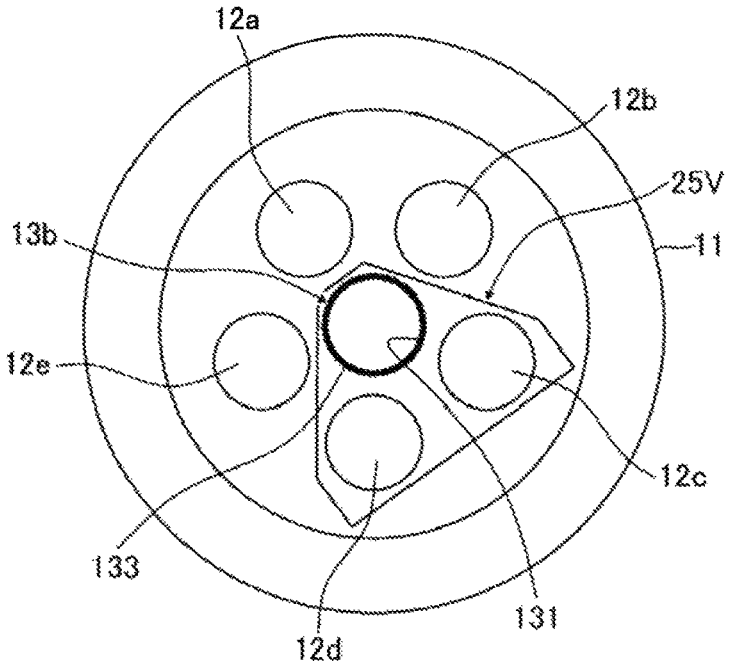
FIG. 8 is a schematic vertical cross-sectional view of a combining unit according to a second embodiment of the present disclosure, which is installable in the image forming apparatus depicted in FIG. 1.

Referring to FIG. 8, a description is provided of a construction of the fixing device 1 according to a second embodiment of the present disclosure.

Identical reference numerals are assigned to components identical or equivalent to the components incorporated in the fixing device 1 according to the first embodiment described above and a description of the identical components is omitted.

FIG. 8 is a schematic vertical cross-sectional view of a combining unit 25V. As illustrated in FIG. 8, the combining unit 25V includes a heating adjuster 13*b* unlike the combining unit 25 incorporating the heating adjuster 13 depicted in FIG. 3. For example, as illustrated in FIG. 8, the heating adjuster 13*b* includes the adjusting portion 131 made of the glass tube or the like depicted in FIG. 4 and a reflection layer 133 serving as a reflector surrounding the adjusting portion 131. The reflection layer 133 of the heating adjuster 13*b* reflects heat radiated from the infrared heaters 12 (e.g., the infrared heaters 12*a*, 12*b*, 12*c*, 12*d*, and 12*e*) to prevent one infrared heater 12 from overheating another infrared heater 12.

For example, the reflection layer 133 is made of gold, silver, or the like that is resistant against high temperatures about 900 degrees centigrade and reflects heat. Alternatively, the reflection layer 133 may be made of steel special use stainless (SUS) or aluminum according to the heat resistant temperature. The reflection layer 133 is produced by coating a glass tube with gold or the like, for example.

The reflection layer 133 may have surface asperities (e.g., a projection and a recess) to reflect heat toward the inner circumferential surface of the heating roller 11. Alternatively, the reflection layer 133 may perform diffuse reflection. That is, the reflection layer 133 may be treated with processing to reduce an amount of heat reflected by the reflection layer 133 and conducted to the infrared heaters 12.

Instead of mounting the reflection layer 133, a surface of the glass tube is treated with direct processing such as frosted glass to reflect heat. Alternatively, the heating adjuster 13*b* may be a hollow tube made of gold, SUS, or the like or a solid bar.

According to this embodiment also, the combining unit 25V includes the heating adjuster 13*b* combined with one or more infrared heaters 12. Accordingly, like in the first embodiment, the combining unit 25V is assembled separately from assembly of the fixing device 1. When the fixing device 1 is assembled, the combining unit 25V that has been assembled is installed into the fixing device 1, preventing the heating adjuster 13*b* from coming into contact with the infrared heaters 12*c* and 12*d* and facilitating installation of the combining unit 25V into the fixing device 1 during assembly of the fixing device 1.

According to this embodiment, since the heating adjuster 13*b* has the reflection layer 133 as an outer circumferential surface layer that reflects heat, the heating adjuster 13*b* reduces heat conducted directly from one infrared heater 12 to another infrared heater 12 disposed opposite the one infrared heater 12, thus decreasing overheating of the another infrared heater 12 to a temperature above the specified temperature. Consequently, the heating adjuster 13*b* suppresses thermal degradation of the infrared heaters 12. Hence, the heating adjuster 13*b* extends the life of the infrared heaters 12.

Since the heating adjuster 13*b* reflects heat toward the inner circumferential surface of the heating roller 11, the heating adjuster 13*b* uses heat, which might be absorbed by the heating adjuster 13 depicted in FIG. 3, to heat the heating roller 11, thus enhancing heating efficiency.

According to the second embodiment also, the heating adjuster 13*b* may be hollow or solid. The shape of the heating adjuster 13*b* in cross-section may be circular or polygonal. The heating adjuster 13*b* may include a plurality of tubes or a plurality of bars.

Figure 9:
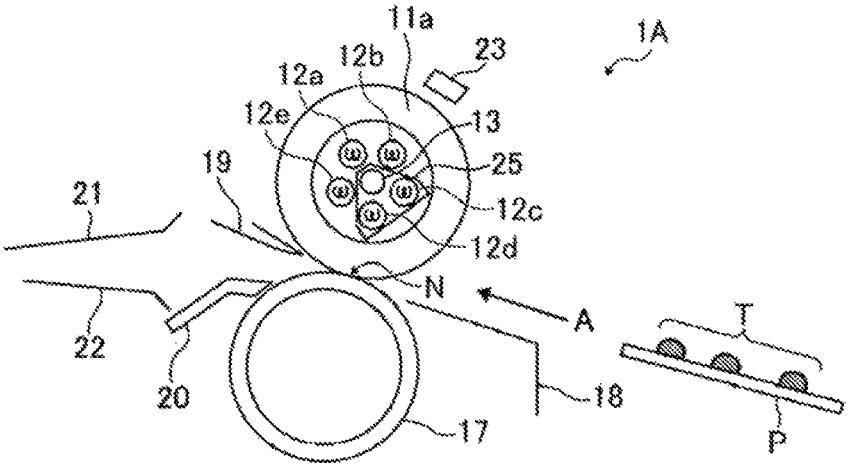
FIG. 9 is a schematic vertical cross-sectional view of a fixing device according to a third embodiment of the present disclosure, which is installable in the image forming apparatus depicted in FIG. 1.

Referring to FIG. 9, a description is provided of a construction of a fixing device 1A according to a third embodiment of the present disclosure.

Identical reference numerals are assigned to components identical or equivalent to the components incorporated in the fixing device 1 according to the first embodiment and the second embodiment described above and a description of the identical components is omitted.

FIG. 9 is a schematic vertical cross-sectional view of the fixing device 1A. As illustrated in FIG. 9, the fixing device 1A (e.g., a fuser or a fusing unit) includes a heating roller 11*a* serving as a heating rotator, the plurality of infrared heaters 12*a*, 12*b*, 12*c*, 12*d*, and 12*e*, the heating adjuster 13, the pressure roller 17, the entry guide 18, the separation plate 19, the separation claw 20, the upper exit guide 21, the lower exit guide 22, and the temperature sensor 23. That is, the fixing device 1A employs the heating roller fixing system.

The plurality of infrared heaters 12*a*, 12*b*, 12*c*, 12*d*, and 12*e*, the heating adjuster 13, the pressure roller 17, the entry guide 18, the separation plate 19, the separation claw 20, the upper exit guide 21, the lower exit guide 22, and the temperature sensor 23 of the fixing device 1A according to the third embodiment are equivalent to those of the fixing device 1 according to the first embodiment. The combining unit 25 of the fixing device 1A is equivalent to that of the fixing device 1 according to the first embodiment.

The heating roller 11*a* according to the third embodiment is a tubular hollow roller made of aluminum or iron, for example. Inside the heating roller 11*a* are the five infrared heaters 12, that is, the five infrared heaters 12*a*, 12*b*, 12*c*, 12*d*, and 12*e*. Further, the heating adjuster 13 is disposed inside the heating roller 11*a*. The pressure roller 17 is pressed against the heating roller 11*a* to form the fixing nip N therebetween. Thus, the heating roller 11*a* also serves as a fixing rotator like the fixing roller 14 depicted in FIG. 2 serving as a fixing rotator.

FIG. 9 illustrates the heating adjuster 13 according to the first embodiment depicted in FIG. 3. Alternatively, the fixing device 1A may include the heating adjuster 13*a* depicted in FIG. 6 or the heating adjuster 13*b* according to the second embodiment depicted in FIG. 8.

According to this embodiment, the fixing device 1A includes the pressure roller 17 pressed against the heating roller 11*a* to form the fixing nip N between the pressure roller 17 and the heating roller 11*a*. Thus, the fixing device 1A attains the heating roller fixing system in which the heating roller 11*a* melts and fixes the unfixed toner image T on the sheet P while downsizing the fixing device 1A.

According to the embodiments described above, when the fixing device 1 incorporated in the image forming apparatus 200 depicted in FIG. 1 is assembled, the infrared heaters 12 and the heating adjuster 13 are installed into the fixing device 1 smoothly while the heating adjuster 13 does not come into contact with the infrared heaters 12. Additionally, the heating adjuster 13 suppresses thermal degradation of heaters such as the infrared heaters 12. Hence, the heating adjuster 13 extends the life of the infrared heaters 12 and suppresses increase in maintenance costs that might be caused by replacement of parts or the like.

FIG. 1 illustrates the image forming apparatus 200 that incorporates the fixing device 1. Alternatively, the image forming apparatus 200 may incorporate the fixing device 1A depicted in FIG. 9.

A description is provided of advantages of the fixing devices 1 and 1A.

As illustrated in FIGS. 2, 3, 4, 6, 8, and 9, a fixing device (e.g., the fixing devices 1 and 1A) includes a plurality of heaters (e.g., the infrared heaters 12*a*, 12*b*, 12*c*, 12*d*, and 12*e*), a tubular rotator (e.g., the heating rollers 11 and 11*a*), a heating adjuster (e.g., the heating adjusters 13, 13*a*, and 13*b*), and a joint (e.g., the joint 26).

The plurality of heaters extends in a longitudinal direction thereof. The plurality of heaters is disposed inside the tubular rotator. The heating adjuster adjusts conduction of heat from one of the plurality of heaters to another one of the plurality of heaters. For example, the plurality of heaters includes a first heater and a second heater. The heating adjuster is interposed between the first heater and the second heater to adjust heat conduction from the first heater to the second heater. The joint combines the heating adjuster with at least one of the plurality of heaters. For example, the joint combines the heating adjuster with the second heater.

Accordingly, since the joint combines the heating adjuster with at least one of the plurality of heaters, the joint suppresses contact of the heating adjuster with the heater.

For example, when the heating adjuster and the heaters are assembled inside the fixing device, the joint suppresses contact of the heating adjuster with the heaters.

According to the embodiments described above, each of the heating rollers 11 and 11*a* serves as a tubular rotator. Alternatively, a fixing belt, a fixing film, a fixing sleeve, or the like may be used as a tubular rotator. Further, the pressure roller 17 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fixing device, comprising:

a tubular rotator;

a first heater disposed inside the tubular rotator and extended in a longitudinal direction of the first heater, the first heater to heat the tubular rotator;

a second heater disposed inside the tubular rotator and extended in a longitudinal direction of the second heater, the second heater to heat the tubular rotator;

a heating adjuster, interposed between the first heater and the second heater, to adjust heat conduction from the first heater to the second heater, wherein the heat adjuster is a non-heat generator that does not generate heat, but absorbs heat generated by the first and second heaters so as to cool the first and second heaters; and a joint combining the heating adjuster with the second heater.

2. The fixing device according to claim 1, wherein the joint combines a lateral end of the heating adjuster in a longitudinal direction of the heating adjuster with a lateral end of the second heater in the longitudinal direction of the second heater.

3. The fixing device according to claim 1, wherein a distance between the heating adjuster and each of the first heater and the second heater is at least a predetermined distance.

4. The fixing device according to claim 1, wherein the heating adjuster is made of glass.

5. The fixing device according to claim 4, wherein the heating adjuster is made of quartz glass.

6. The fixing device according to claim 1, wherein the tubular rotator includes a heating rotator.

7. The fixing device according to claim 6, further comprising:

a fixing rotator;

a belt being rotatable and stretched taut across the fixing rotator and the heating rotator; and a pressure rotator to press against the fixing rotator via the belt to form a fixing nip between the pressure rotator and the belt.

8. The fixing device according to claim 6, further comprising:

a pressure rotator to press against the heating rotator to form a fixing nip between the pressure rotator and the heating rotator.

9. The fixing device according to claim 6, wherein the heating rotator includes a heating roller.

10. The fixing device according to claim 1, wherein the heating adjuster includes a solid bar.

11. The fixing device according to claim 1, wherein the heating adjuster includes a hollow tube.

12. The fixing device according to claim 1, further comprising another heating adjuster, interposed between the first heater and the second heater, to adjust heat conduction from the first heater to the second heater.

13. The fixing device according to claim 1, wherein the heating adjuster includes an adjusting portion to adjust heat conduction from the first heater to the second heater.

14. The fixing device according to claim 13, wherein the heating adjuster further includes a reflection layer, surrounding the adjusting portion, to reflect heat radiated from the first heater and the second heater.

15. The fixing device according to claim 13, wherein the adjusting portion includes a glass tube.

16. The fixing device according to claim 13, wherein the second heater includes:

a heating portion to generate heat; and a sealing portion adjoining a lateral end of the heating portion in the longitudinal direction of the second heater.

17. The fixing device according to claim 16, wherein the heating adjuster further includes a sealing portion adjoining a lateral end of the adjusting portion of the heating adjuster in a longitudinal direction of the heating adjuster.

18. The fixing device according to claim 17, wherein the adjusting portion of the heating adjuster is disposed opposite the heating portion of the second heater and adjusts heat conduction.

19. The fixing device of claim 1, further comprising a third heater disposed inside the tubular rotator and extended in a longitudinal direction of the third heater, the third heater to heat the tubular rotator, wherein the first, second, and third heaters are arranged to surround the heat adjuster in a circumferential direction.

20. A fixing device comprising:

a tubular rotator;

a first heater disposed inside the tubular rotator and extended in a longitudinal direction of the first heater, the first heater to heat the tubular rotator;

a second heater disposed inside the tubular rotator and extended in a longitudinal direction of the second heater, the second heater to heat the tubular rotator;

a heating adjuster, interposed between the first heater and the second heater, to adjust heat conduction from the first heater to the second heater; and a joint combining the heating adjuster with the second heater, wherein the heating adjuster includes an adjusting portion to adjust heat conduction from the first heater to the second heater, the second heater includes a heating portion to generate heat, and a sealing portion adjoining a lateral end of the heating portion in the longitudinal direction of the second heater, the heating adjuster further includes a sealing portion adjoining a lateral end of the adjusting portion of the heating adjuster in a longitudinal direction of the heating adjuster, and the joint includes a plurality of through holes into which the sealing portion of the heating adjuster and the sealing portion of the second heater are inserted, respectively.

21. An image forming apparatus, comprising:

an image forming device to form a toner image on a recording medium; and a fixing device to fix the toner image on the recording medium, the fixing device including:

a tubular rotator;

a first heater disposed inside the tubular rotator and extended in a longitudinal direction of the first heater, the first heater to heat the tubular rotator;

a second heater disposed inside the tubular rotator and extended in a longitudinal direction of the second heater, the second heater to heat the tubular rotator;

a heating adjuster, interposed between the first heater and the second heater, to adjust heat conduction from the first heater to the second heater, wherein the heat adjuster is a non-heat generator that does not generate heat, but absorbs heat generated by the first and second heaters so as to cool the first and second heaters; and a joint combining the heating adjuster with the second heater.

* * * * *